United States Patent [19]

Christiana et al.

[11] 4,093,132

[45] June 6, 1978

[54] METHOD OF WINDING A MAGNETIC DEFLECTION YOKE

[75] Inventors: William R. Christiana, Saugerties; Joseph F. Hevesi, Hurley, both of N.Y.

[73] Assignee: International Business Machines Corporation, Armonk, N.Y.

[21] Appl. No.: 597,266

[22] Filed: Jul. 18, 1975

Related U.S. Application Data

[60] Continuation of Ser. No. 392,847, Aug. 29, 1973, abandoned, which is a continuation of Ser. No. 134,901, Apr. 16, 1971, abandoned, which is a division of Ser. No. 7,275, Jan. 30, 1970, Pat. No. 3,601,731.

[51] Int. Cl.[2] ..... H01F 41/08

[52] U.S. Cl. ..... 242/7.03; 242/1.1 R; 242/4 R

[58] Field of Search ..... 242/1.1 R, 1.1 A, 7.03, 242/4 R, 4 A, 4 B; 29/6, 605

[56] References Cited

U.S. PATENT DOCUMENTS

| | | | |
|---|---|---|---|
| 2,647,696 | 8/1953 | Brunand | 242/1.1 R |
| 2,770,424 | 11/1956 | Grove | 242/1.1 R |
| 3,082,966 | 3/1963 | Friedrich | 242/1.1 R |
| 3,226,046 | 12/1965 | Dröll et al. | 242/1.1 R |
| 3,253,793 | 5/1966 | Money et al. | 242/1.1 R |
| 3,334,825 | 8/1967 | Friedrich | 242/1.1 R |

*Primary Examiner*—Billy S. Taylor
*Attorney, Agent, or Firm*—Frederick D. Poag

[57] ABSTRACT

The method of winding a cathode ray tube, magnetic deflection yoke. The yoke is formed with an annular core with non-electrically conductive, non-magnetic end caps. The end caps have a series of hook members separated by slots, with the slots of one end cap aligned with those of the opposite end cap and the hook members defining radially outwardly displaced annular channels in the respective caps. To wind the yoke, wire is fed under tension axially through the core and a slot in one end cap, then radially outward between a pair of adjacent hooks around and along one of the channels behind a predetermined number of hooks, thence radially inward between a separate pair of hooks and axially in the opposite direction toward the second end cap where the same procedure is repeated until a bundle of wire turns is formed on the yoke in a predetermined pattern.

1 Claim, 9 Drawing Figures

METHOD OF WINDING A MAGNETIC DEFLECTION YOKE

CROSS REFERENCE TO RELATED APPLICATIONS

This is a continuation of application Ser. No. 392,847 filed Aug. 29, 1973, now abandoned, which was a continuation of application Ser. No. 134,901 filed Apr. 16, 1971, now abandoned, which was a division of application Ser. No. 7,275, filed Jan. 30, 1970, now U.S. Pat. No. 3,601,731.

BACKGROUND OF THE INVENTION

The present invention relates to precision coil structures and methods for winding such structures and, in particular, to an improved configuration for deflection coils in magnetic deflection yokes and a method for winding a precisely defined magnetic deflection yoke.

Deflection coils for electron beams normally include longitudinal portions, radial portions, and transverse portions. The longitudinal portions are generally along the axis of the electron beam device such as a cathode ray tube. Current through the longitudinal portions produces a component of magnetic field that is transverse to the axis of the beam which causes a deflection of the beam. Current flowing through the radial portions and the transverse portions of deflection coils produce components of magnetic field axially directed which tends to defocus the electron beam.

A usual production technique in the manufacture of magnetic deflection yokes is to wind the coils on a bobbin device separate from the yoke core and then fit the coils onto the core. As a result, it is difficult or impossible to achieve precision or predictability as to placement or distribution of either the longitudinal portions, the radial portions or the transverse portions of each coil or group of coils. Hence, such magnetic deflection yokes do not have predictable magnetic field patterns.

Imprecision in the deflection coils results in various distortions when an image is displayed on the face of a cathode ray tube. One is the defocusing of the spot and changes in its shape at positions away from the center of the CRT, and another is the lack of perpendicularity between the $x$ and $y$ components due to the imprecise placement of the $x$ and $y$ deflection coils with respect to each other.

Prior art attempts to correct the distortions due to imprecise placement and distribution of deflection coils have included very high cost methods requiring manual winding and forming of deflection coils.

Accordingly, it is an object of the present invention to wind deflection coils which will produce predictable magnetic fields.

A further object is to wind deflection coils on an internally slotted core structure with end caps arranged to achieve a high degree of repeatability among a large number of coils produced.

A still further object of the present invention is to reduce defocusing and distortion due to end effects of the magnetic deflection coils.

Other objects of the invention are to provide, in an improved deflection yoke as aforesaid, a core structure on which the coils are wound in their final position, and which provides desired lineal response in the operation of the yoke.

Another object of the present invention is to provide a low cost magnetic deflection yoke which will produce a predictable magnetic field for deflecting an electron beam.

SUMMARY

The instant invention is embodied in a magnetic deflection yoke including a plurality of deflection coils and in a method for making a magnetic deflection yoke. A deflection yoke, in which deflection coils are precisely placed in slots in the core and held in precise position by a number of hook members affixed at either end of the core, is wound as follows:

(1) The core with end caps affixed is mounted on a winding fixture;
(2) A wire is fed under tension along one of the slots in the core;
(3) The wire under tension is then hooked around an end cap at the end of the core;
(4) The core is then rotated through angle $\delta$;
(5) The wire is fed under tension axially along another slot to the opposite end of the core;
(6) The wire is then hooked around a hook member on the other end cap;
(7) The core is later rotated through an angle $2\delta$; and
(8) The steps are repeated through slots flanking the first pair, and so on.

The hook members on the end caps define annular channels which place and maintain the end turns of the coils in tight transverse bundles positioned to minimize interference with the useful components of the operating fields of the yoke.

These and other objects and advantages of the invention will be explained in further detail with reference to the accompanying drawings.

DETAILED DESCRIPTION OF THE INVENTION

Figure 1:
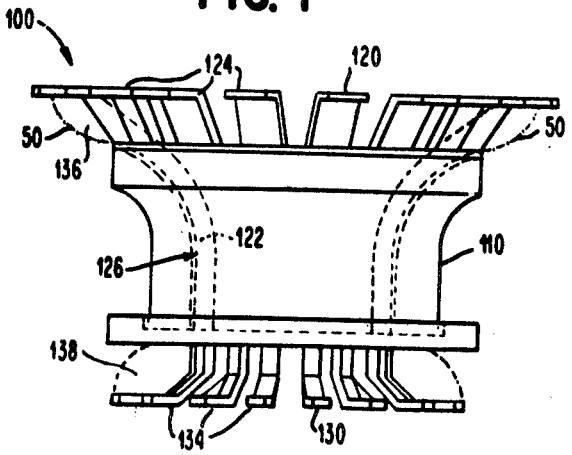
FIG. 1 is a side view of a magnetic deflection yoke which represents one preferred embodiment of the instant invention.

Referring now to FIG. 1, a magnetic deflection yoke with a tapered core is shown as one embodiment of the present invention.

Yoke 100 includes a core structure which is flared outwardly towards the front, and includes a ferromagnetic body 110 and slotted end caps 120 and 130. Windings 50 are shown in phantom to reveal the core structure details. End cap 120 includes hook members 124, and an extension 126 which forms a core liner having longitudinal slots 122. Rear end cap 130 abuts with extension 126 and body 110 and is positioned so that the slots in extension 126 are in alignment with the slots in rear end cap 130. Rear end cap 130 includes hook members 134 for holding the windings 50 precisely in position. Each of the arrays of hooks 120 and 130 defines an annular channel 136, 138 for receiving the end turns of coils 50.

Figure 3:
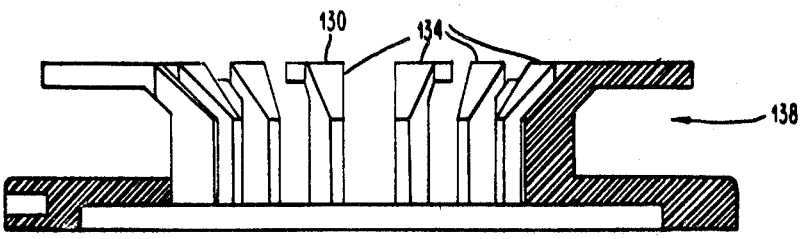

Referring now to FIG. 3, a cross-section of rear end cap 130 is shown. End caps 120 and 130 are formed of phenolic or hard plastic material. The extended slots in end cap 120 are aligned with the slot formed between hook members 134 in end cap 130 and cemented in place. The hook members 124 on end cap 120 and 134 on end cap 130 enable precise positioning of each turn of each coil in a magnetic deflection yoke.

Figure 7:
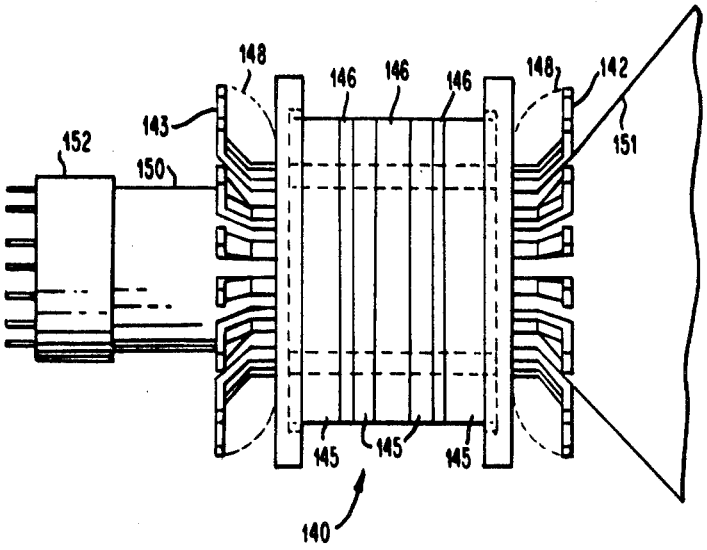
FIG. 7 is a cross-section view of a cylindrical shaped magnetic deflection yoke according to another embodiment of the present invention.

Referring now to FIG. 7, an alternate embodiment of the present invention is shown in which the yoke 140 is cylindrical in shape. In this embodiment, the end caps 142, 143 are identical and the windings 148 lie in a plane parallel to the undeflected direction of electron beam in slots formed in the ferromagnetic core body.

The embodiment of FIG. 7 also illustrates an alternative composition of the core wherein the core is composed of interleaved sections 145 of magnetic materials with sections 146 of non-magnetic material to modify the magnetic flux pattern produced by the deflection yoke. The non-magnetic sections 146 are slotted as well as the magnetic sections 145 of the core and these slots must be aligned with each other and with the slots in end caps 142 and 143 to allow precise positioning of the deflection coils. It will be understood the embodiments of FIGS. 1 and 7 are given as examples, and that either could be constructed with features, such as the composite core or the plastic liner, of the other. Moreover, the core structure could be of the "air core" kind, in which the entire tooth, slot and liner assembly is non-magnetic.

Figure 4:
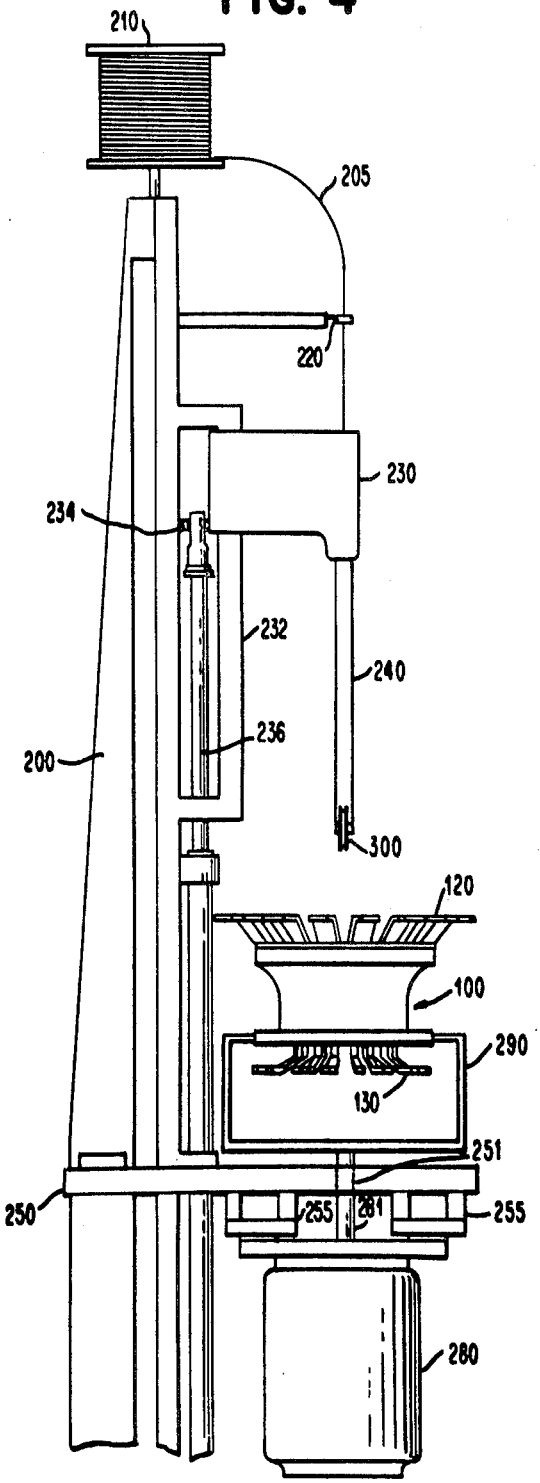
FIG. 4 shows apparatus for winding deflection coils for a magnetic deflection yoke according to the instant invention.

Referring now to FIG. 4, a fixture is shown which may be used to automatically wind deflection coils on a yoke frame such as shown in FIGS. 1 and 7.

Yoke 100 is mounted on fixture 290. The yoke is rotatable by motor 280, which is mounted on slides 255 hung from base plate 250.

Wire 205 is fed from spool 210 through guide 220 to slide head 230 carrying a tool 240 which has a hole drilled through it to allow the wire to pass. Slide head 230 is reciprocally mounted on track 232 and connected to driving rod 236 by coupler 234. Driving rod 236 imparts linear motion to slide head 230 along track 232 to cause feeding head 300 of tool 240 to move along the axis of the yoke. Motor 280 is connected to fixture 290 by shaft 281 which passes through a slot 251 in plate 250. Means not shown cause the motor 280 to move along slides 255 in the *z* axis perpendicular to the page to move yoke 100 in order to allow feeding head 300 to clear hook members 134 on rear end cap 130 and hook members 124 on end cap 120.

Figure 5A:
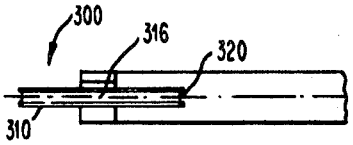
FIGS. 5A and 5B show enlarged front and side views of the wire feeding tool of FIG. 4, used to feed wire around the end caps of the deflection yoke.
Figure 5B:
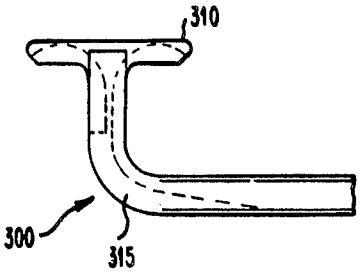

Referring now to FIGS. 5A and 5B, feeding tool head 300 is shown with trumpet-shaped end 310 which enables reversing the direction of the wires around the end caps of the core assembly, and trough 320 which guides the wire during the winding of a deflection coil. The wire is fed through slot 315 at the rear of the feeding tool 300 and out through hole 316 to trough 320.

Referring again to FIG. 7, a cylindrical yoke embodiment of the present invention is shown mounted on the neck 150 of a CRT. The trumpet or flare shaped yoke 100 mounts on a CRT in the same manner as the cylindrical yoke 140. However, the flared yoke 100 is capable of being positioned further up on the bell 151 of the CRT.

OPERATION

Figure 2:
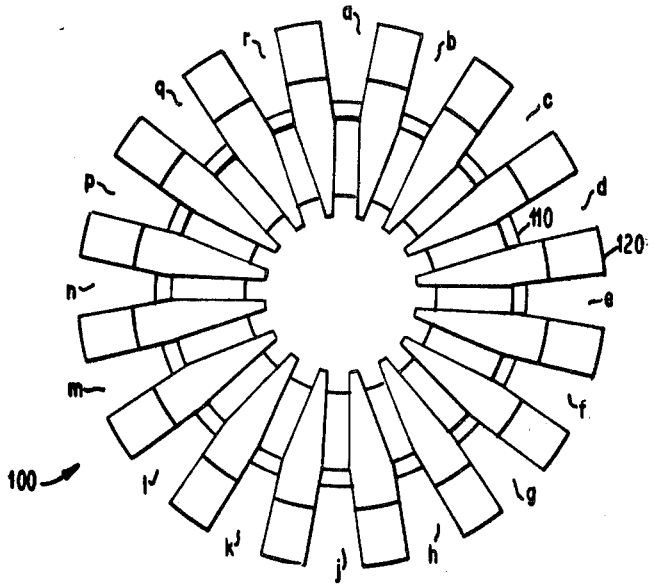
FIGS. 2 and 3 are detail views of the front and rear end cap structures of the yoke of FIG. 1.

Referring now to FIGS. 2 and 4, the method of winding deflection coils to precisely position each turn of each coil and reduce distortion will be described.

Feeding tool 300 feeds wire 205 under tension from a terminal (not shown), along a slot formed by end cap 120. For example, the first wire might be placed in slot *e*. Feeding tool 300 proceeds beyond the lower end cap 130 to clear the teeth and any wire bundle previously built up in the trough 138. The fixture 290 is then displaced in the *z* axis to allow the feeding tool to clear hook members 134 radially, and then the probe is retracted slightly to place the feed head in line with annular trough 138. Motor 280 then indexes yoke 100 through an angle $\delta$ which aligns feeding tool with another of the slots, for example, slot *f*. Feeding tool 300 hooks the wire under tension around the hook member 134 in the lower end cap and the tool 300 is again lowered to clear the teeth. The fixture is then displaced along the *z* axis to align the feeding tool with the yoke axis again. The feeding tool 300 is then withdrawn drawing the wire under tension along slot *f* until the tool is clear of the upper end cap 120. The fixture is then displaced in the *z* and vertical axes to allow the feeding tool 300 to clear the hook members 124 in the upper end cap 120 analogously to the aforedescribed hooking motions. Motor 280 again indexes the yoke 100 through an angle $\delta$ and a second turn is wound in slots *e* and *f*. After a specified number of turns are wound in slots *e* and *f*, the yoke is indexed through angle $\delta+\delta$ and the wire is then fed downwardly under tension along slot *d*.

When feeding tool 300 is clear of the end cap 130, fixture 290 is displaced along the vertical and *z* axes as before to allow the feeding tool to clear the hook members 134 on end cap 130. Motor 280 rotates the yoke through an angle $3\delta$ causing the wire under tension to be fed behind the hooks of the end cap to the next slot, in the example, slot *g*. The wire is then fed under upwardly tension along slot *g* to the upper end of the yoke clear of end cap 120, and the fixture is rotated by motor 280 back through the angle $3\delta$ to slot *d*.

The process of winding is continued with successive turns of wire being fed along the slots *d* and *g*, and then additionally flanking slot pairs *e* and *h* and *b* and *j*, the fixture and tool being moved as described above to complete one multisection coil. In a magnetic deflection yoke there are normally such four coils. Two coils deflect the electron beam in the positive and negative vertical direction from a center point and two coils deflect the electron beam in the horizontal direction from the same center point.

In the winding apparatus shown in FIG. 4, each of the coils is wound in sequence and the wire ends are brought to terminals (not shown) for connection to the deflection circuitry. In the example given, each coil covers nearly 180°, and so the vertical and horizontal coils will overlap in the annular channels 136, 138. If desired, the hook members 120, 130 can be provided with secondary tooth-like projections (not shown) dividing the channels 136, 138 into subchannels to separate the end turns of the vertical and horizontal coils.

Although the method shown has been described in relation to a particular winding apparatus, the inventive method is equally applicable to winding deflection coils by hand since the preformed slots preferably position the wire and the hook members hold the end portion of the winding securely in position. Thus, the aforedescribed method can be performed manually by using one's hands to hold the yoke and the wire so as to perform the same relative movements between the hand held yoke and the point of feed at which one holds the wire. Following the same steps as aforedescribed, one would feed wire 205 under tension from a terminal (not shown), along a slot, such as slot *e*, formed by end cap 120, and then bring the wire beyond the lower end cap 130 to clear the teeth and any wire bundle previously built up in the trough 138. Next one would feed the wire radially of the yoke to allow it to clear hook members 134 radially, and then the wire feeding point would be retracted slightly to place the point of feeding in line with annular trough 138. Then one would index yoke 100 through an angle $\delta$ relative to the point of feeding to align the point of feeding with another of the slots, for example, slot *f*. The point of feeding is then moved to hook the wire under tension around the hook member 134 in the lower end cap and downwardly to clear the teeth. The point of feeding is then displaced inwardly to align the point of feeding with the yoke axis again. The point of feeding is then withdrawn drawing the wire under tension along slot *f* until it is clear of the upper end cap 120. The point of feeding is then displaced in the radial and axial directions to clear the hook members 124 in the upper end cap 120 analogously to the aforedescribed hooking motions, and so on.

Thus one's hands can hold the yoke and manipulate the wire along the same paths as described with reference to apparatus for that purpose, so as to effect the steps set forth in the "Summary" above.

Figure 6A:
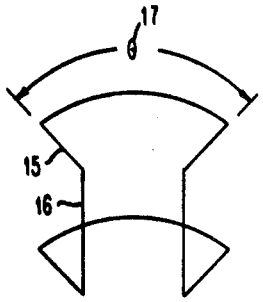
FIG. 6A shows the shape of a single turn of a deflection coil wound according to the present invention.
Figure 6B:
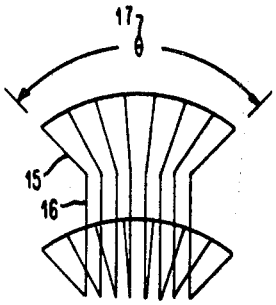
FIG. 6B shows a multiple turn section of a deflection coil wound according to the present invention.

FIG. 6A shows a skeleton view of the overall shape of a coil as aforedescribed FIG. 6B shows how the winding segments in the slots *b* through *j* cooperate to form the overall coil pattern. Longitudinal portion 16 is the portion of each coil which lies in the slot along the axis of the core. Radial portion 15 represents the portion of the coils which are perpendicular to the axis of the core and which hook behind the hook members of the end caps. Transverse portions 17 are those parts of the windings that are designated by angle $\theta$ and which produce no useful deflection component. Transverse portions 17 are maintained in a position perpendicular to the axis of the yoke and outwardly displaced from portions 16 to avoid undesired end effects.

A yoke constructed according to the present invention will produce predictable magnetic fields with reduced spot focusing and distortion.

While the invention has been particularly shown and described with reference to preferred embodiments thereof, it will be understood by those skilled in the art that various changes in form and detail may be made therein without departing from the spirit and scope of the invention.

What is claimed is:

1. A method of winding a cathode ray tube magnetic deflection yoke with winding end turns produced in situ in defined bundles located radially outwardly from the axial portion of the winding, comprising the steps of:

(a) providing a subassembly comprising an annular core portion and first and second end caps at each end of said core portion forming permanent operative parts of said yoke, said end caps being of non-electrically conductive non-magnetic material and comprising a plurality of hook members separated by a plurality of slots, said plurality of slots being aligned to form longitudinal troughs along the axis of said core portion and said hooks being radially directed and spaced around the perimeter of said end caps to define corresponding first and second annular channels displaced radially outwardly from said longitudinal troughs, and using said subassembly as a wire forming and retaining tool by:

(b) feeding wire:

under tension along one of said troughs toward said first end cap, through the slot in said first end cap defining the end of said one trough, radially outwardly between and behind the hook members flanking said slot and then under tension along said annular channel to another of the hooks in said first end cap, then under tension in the reverse axial direction through the slot and trough immediately beyond said other of the hooks, (c) hooking said wire in like manner behind the corresponding one of the hook members in said second end cap and feeding said wire in like manner but in the opposite direction along said second annular channel, and (d) continuing feeding said wire back and forth between said end caps to form coil loops having axially directed longitudinal portions and annularly directed end turns portions, said end turns being formed and held in defined bundles located radially outwardly from said longitudinal portions by said annular channels formed by said hook members.

* * * * *